US005672415A

United States Patent [19]

Sawyer et al.

[11] Patent Number: 5,672,415

[45] Date of Patent: Sep. 30, 1997

[54] LOW DENSITY MICROFIBER NONWOVEN FABRIC

[75] Inventors: Lawrence Howell Sawyer; Linda Ann Connor, both of Roswell; Samuel Edward Marmon, Alpharetta, all of Ga.

[73] Assignee: Kimberly-Clark Worldwide, Inc., Irving, Tex.

[21] Appl. No.: 565,328

[22] Filed: Nov. 30, 1995

[51] Int. Cl.[6] ..... B32B 7/02

[52] U.S. Cl. ..... 428/219; 442/347; 442/350; 442/351; 442/362; 442/364

[58] Field of Search ..... 428/288, 219; 442/347, 351, 350, 362, 364

[56] References Cited

U.S. PATENT DOCUMENTS

| | | | |
|---|---|---|---|
| 3,692,618 | 9/1972 | Dorschner et al. | 161/72 |
| 3,802,817 | 4/1974 | Matsuki et al. | 425/66 |
| 3,824,625 | 7/1974 | Green | 2/114 |
| 3,911,499 | 10/1975 | Benevento et al. | 2/114 |
| 4,041,203 | 8/1977 | Brock et al. | 428/157 |
| 4,118,531 | 10/1978 | Hauser | 428/224 |
| 4,234,655 | 11/1980 | Kunimune et al. | 428/374 |
| 4,307,143 | 12/1981 | Meitner | 252/91 |
| 4,315,881 | 2/1982 | Nakajima et al. | 264/171 |
| 4,323,626 | 4/1982 | Kunimune et al. | 428/374 |
| 4,340,563 | 7/1982 | Appel et al. | 264/518 |
| 4,381,335 | 4/1983 | Okamoto | 428/373 |
| 4,469,540 | 9/1984 | Furukawa et al. | 156/62.4 |
| 4,547,420 | 10/1985 | Krueger et al. | 428/229 |
| 4,551,378 | 11/1985 | Carey, Jr. | 428/198 |
| 4,557,972 | 12/1985 | Okamoto et al. | 428/373 |
| 4,839,228 | 6/1989 | Jezic et al. | 428/401 |
| 4,883,707 | 11/1989 | Newkirk | 428/219 |
| 5,047,189 | 9/1991 | Lin | 264/103 |
| 5,108,820 | 4/1992 | Kaneko et al. | 428/198 |
| 5,133,917 | 7/1992 | Jezic et al. | 264/210.8 |
| 5,213,881 | 5/1993 | Timmons et al. | 428/224 |
| 5,244,724 | 9/1993 | Antonacci et al. | 428/288 |
| 5,382,400 | 1/1995 | Pike et al. | 264/168 |
| 5,405,698 | 4/1995 | Dugan | 428/373 |

FOREIGN PATENT DOCUMENTS

| | | |
|---|---|---|
| 0 618 316 | 10/1994 | European Pat. Off. . |
| 60-57520 | 3/1994 | Japan . |
| 93/01334 | 1/1993 | WIPO . |

*Primary Examiner*—Christopher Raimund
*Attorney, Agent, or Firm*—William D. Herrick

[57] ABSTRACT

The present invention provides a lofty nonwoven web containing pneumatically drawn filaments, wherein the web has a density from about 0.01 g/cc to about 0.075 g/cc and the microfilaments have a weight-per-unit length between about 0.1 dtex and about 1.5 dtex. The invention also provides a process for producing the lofty nonwoven web.

13 Claims, 1 Drawing Sheet

LOW DENSITY MICROFIBER NONWOVEN FABRIC

BACKGROUND OF THE INVENTION

The present invention is related to a nonwoven fabric containing conjugate microfilaments. More particularly, the present invention is related to a nonwoven fabric containing pneumatically drawn conjugate microfilaments.

Synthetic filaments having an average thickness, more specifically weight-per-unit-length, of about 1.5 dtex or less can be characterized as microfilaments, and two commonly used groups of processes for producing microfilaments are meltblown fiber production processes and split fiber production processes. Meltblown fibers are formed by extruding a melt-processed thermoplastic material through a plurality of fine die capillaries as molten filaments into a high velocity heated gas stream, typically heated air, which attenuates the filaments of molten thermoplastic material to reduce their diameter to form meltblown fibers. The fibers, which typically are tacky and not fully quenched, are then carried by the high velocity gas stream and randomly deposited on a collecting surface to form an autogenously bonded web. Meltblown webs are widely used in various applications such as filters, wiping cloths, packaging materials, disposable clothing components, absorbent article components and the like. However, the attenuating step of the meltblown fiber production process imparts only a limited level of molecular orientation in the polymer of the forming fibers, and thus, meltblown fibers and webs containing the fibers do not exhibit high strength properties.

Split fibers, in general, are produced from a multicomponent conjugate fiber which contains typically incompatible polymer components that are arranged to occupy distinct zones across the cross-section of the conjugate fiber and the zones are extended along the length of the fiber. Split fibers are formed when the conjugate fiber is mechanically or chemically induced to split along the interface of the distinct zones within the fiber. Although a split fiber production process can be used to produce fine fibers having relatively high strength properties, the process requires the splitting step and the step tends to be cumbersome and costly. In addition, it is highly difficult to produce completely split fibers from conventional split fiber production processes, and these processes tend to produce compacted or densified structures.

There have been attempts to produce microfilaments that are subsequently cut to form staple fibers. Such microfilaments are produced by forming filaments through spinning apertures of a spinneret and then drawing the filaments, typically with take-up rolls, at a high drawing speed to apply a high drawing ratio. However, as the thickness of microfilaments gets finer, microfilaments and micro staple fibers produced therefrom create processing difficulties. For example, micro staple fibers are highly difficult to open and card, and the fibers tend to form non-uniform nonwoven webs when carded.

Alternatively, there have been attempts to produce microfilament nonwoven webs by modifying spunbond nonwoven web production processes. Spunbond filaments are formed, analogous to a meltblown fiber production process, by melt-processing a thermoplastic polymer through a plurality of fine die capillaries to form molten filaments. Unlike a meltblown fiber production process, however, the formed filaments are not injected into a heated gas stream but are conveyed to a pneumatic drawing unit while being cooled, and drawing forces are applied on the filaments with pressurized gas or air in the pneumatic drawing unit. The drawn filaments exiting the drawing unit, which are relatively crimp-free filaments, are deposited onto a forming surface in random manner to form a loosely entangled fiber web, and then the laid web is bonded under heat and pressure to form melt fused bonded regions in order to impart web integrity and dimensional stability. Spunbond filaments have relatively high molecular orientation, compared to meltblown fibers, and thus exhibit relatively high strength properties. However, spunbond nonwoven webs tend to be compacted and flat due to the uncrimped nature of the spunbond filaments and the compaction bonding process. The production of spunbond webs is disclosed, for example, in U.S. Pat. Nos. 4,340,563 to Appel et al.; 3,692,618 to Dorschner et al. and 3,802,817 to Matsuki et al.

In order to improve the bulk of spunbond webs, production of crimped filament spunbond webs has been proposed. For example, U.S. Pat. No. 5,382,400 to Pike et al. teaches a spunbond web production process which produces lofty spunbond webs containing multicomponent conjugate filaments. The teaching of U.S. Pat. 5,382,400 is highly suitable for producing lofty spunbond webs. However, attempts to produce lofty webs containing finer filaments than conventional spunbond filaments have not been highly successful. It has been found that increasing the pneumatic drawing force and/or reducing the throughput rate of the melt-processed polymer into the die capillaries, which are conventional production means for reducing the thickness of the filaments, substantially eliminate crimps in the fine conjugate filaments. In addition, it has been found that the application of the known means to reduce the size of spunbond filaments does not indefinitely reduce the size of the filaments. As the pneumatic drawing force is increased and/or the throughput rate is decreased to a certain limit, severe spin breaks disrupt the spinning process altogether. Consequently, there is a significant limit in reducing the thickness of spunbond filaments using the conventionally known means, and producing crimped spunbond microfilaments with a conventional spunbond filament production approach is not practicable.

There remains a need for a microfilament nonwoven web that is lofty and has high strength properties.

SUMMARY OF THE INVENTION

The present invention provides a bulky or lofty nonwoven web containing pneumatically drawn filaments, particularly spunbond filaments, wherein the web has a density from about 0.01 g/cc to about 0.075 g/cc and the microfilaments have a weight-per-unit length between about 0.1 dtex and about 1.0 dtex.

Additionally, the invention provides a process for producing a lofty nonwoven web containing spunbond microfilaments, which process has the steps of melt spinning continuous multicomponent conjugate filaments having a high melt flow rate ethylene polymer and a high melt flow rate propylene polymer, the ethylene polymer and propylene polymer being arranged to occupy distinct zones across the cross-section along the length of the conjugate filaments, the ethylene polymer occupying at least a portion of the peripheral surface along the length of the conjugate filaments; quenching the spun conjugate filaments so that the conjugate filaments have latent crimpability; drawing the spun conjugate filaments to form microfilaments; activating the latent crimpability so that the conjugate filaments attain crimps; and depositing the crimped microfilaments to form a nonwoven web, wherein the web has a density from about 0.01 g/cc to about 0.075 g/cc and the microfilaments have a weight-per-unit length between about 0.1 dtex and about 1.5 dtex, and wherein the ethylene polymer is a homopolymer or copolymer of ethylene and has a melt flow rate between about 60 g/10 min. and about 400 g/10 min., as measured in accordance with ASTM D1238-90b, Test Condition 190/2.16, and the propylene polymer is a homopolymer or copolymer of propylene and has a melt flow rate between about 50 g/10 min. and about 800 g/10 min., as measured in accordance with ASTM D1238-90b, Test Condition 230/2.16. Desirably, the conjugate microfilaments are crimped before deposited to form the nonwoven web in order to produce a nonwoven web having uniform filament coverage.

The term "microfilaments" as used herein indicates filaments having a weight-per-unit length of equal to or less than about 1.5 dtex. The term "webs" as used herein refers to fibrous webs and fabrics.

DETAILED DESCRIPTION OF THE INVENTION

Figure 1:
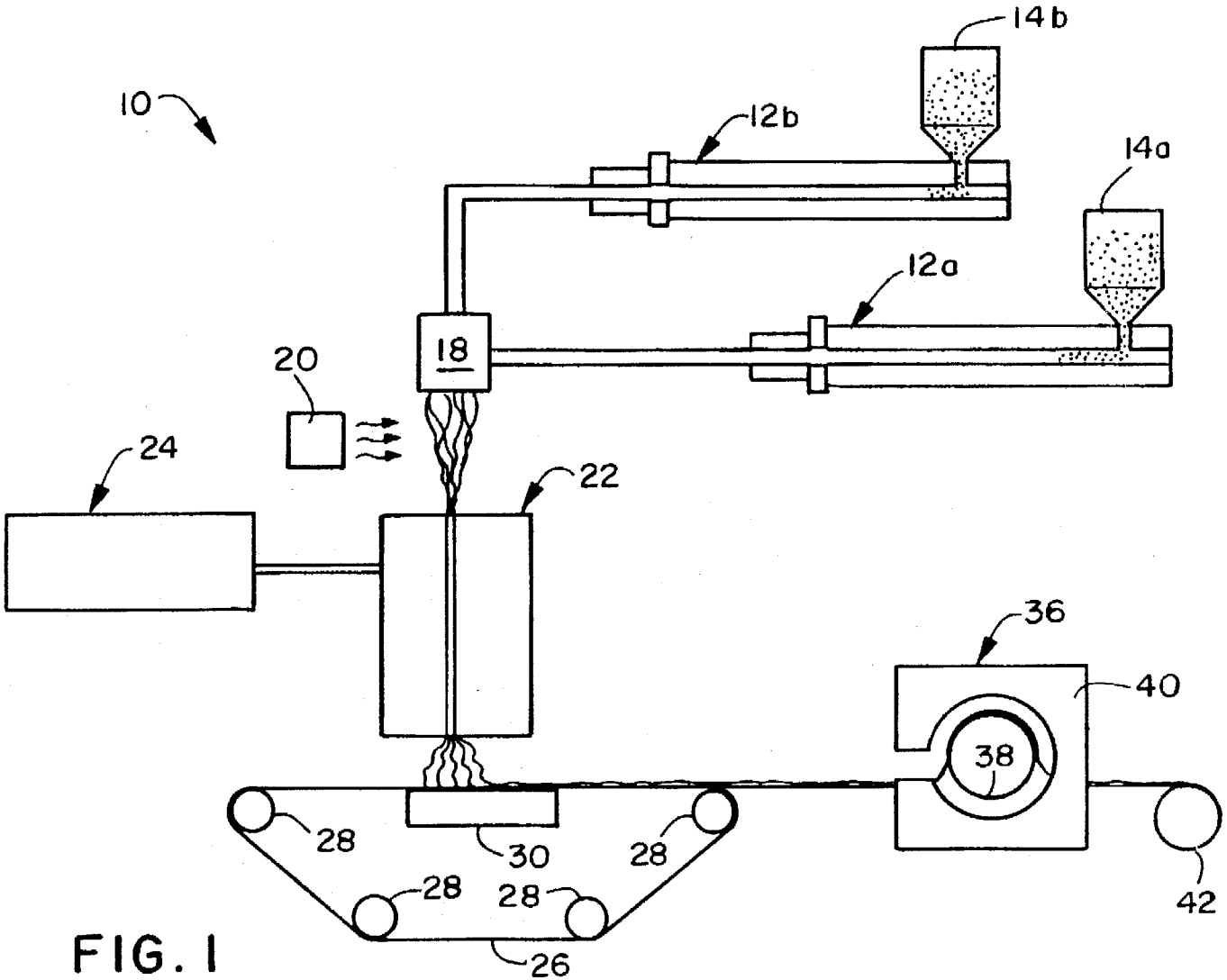
FIG. 1 illustrates an exemplary process for producing the present lofty nonwoven fabric.

The present invention provides a lofty, low-density nonwoven web which contains pneumatically drawn, crimped microfilaments, and the microfilaments are multicomponent conjugate filaments. The multicomponent conjugate filaments contain an ethylene polymer component and a propylene polymer component, although the conjugate filaments may contain alternative and/or additional polymer components that are selected from a wide variety of fiber-forming polymers.

Ethylene polymers suitable for the present invention have a melt flow rate between about 60 and about 400 g/10 min., more desirably between about 100 and about 200 g/10 min., most desirably between about 125 and 175 g/10 min., as measured in accordance with ASTM D1238-90b, Test Condition 190/2.16, before the polymer is melt-processed. Propylene polymers suitable for the present invention have a melt flow rate between about 50 and about 800 g/10 min., more desirably between about 60 and about 200 g/10 min., most desirably between about 75 and 150 g/10 min., as measured in accordance with ASTM D1238-90b, Test Condition 230/2.16, before the polymer is melt-processed. The ethylene and propylene polymers suitable for the present invention can be characterized as being high melt flow rate polymers. In addition, suitable ethylene and propylene polymers for the present invention desirably have a narrower molecular weight distribution than conventional polyethylene and polypropylene for spunbond fibers.

It has been found that using the high melt flow rate ethylene and propylene polymers enables the production of the conjugate spunbond microfilaments and enhances crimpability of the microfilaments, thereby improving the bulk of the nonwoven webs and enabling the production of lower density nonwoven webs. In addition, the microfilaments provide a web having uniform fiber coverage. Accordingly, the conjugate spunbond web of the present invention has highly improved properties, e.g., softness, uniform fiber coverage and hand as well as improved fluid handling properties. Furthermore, it has been found that the high melt flow rate ethylene and propylene polymer compositions can be melt-processed at lower temperatures than conventional ethylene and propylene polymers for spunbond fibers. The processability of the component polymers at low melt-processing temperatures is highly desirable since the low processing temperature significantly abates problems associated with the melt-processing and quenching steps of spunbond fiber web production processes, e.g., thermal degradation of the polymers and undesirable roping of spun filaments.

Ethylene polymers suitable for the present invention include fiber-forming homopolymers of ethylene and copolymers of ethylene and one or more of comonomers, such as, butene, hexene, 4-methyl-1 pentene, octene, vinyl acetate and alkyl acrylate, e.g., ethyl acrylate, and blends thereof. The suitable ethylene polymers may be blended with a minor amount of ethylene alkyl acrylate, e.g., ethylene ethyl acrylate; polybutylene; and/or ethylene-vinyl acetate. Additionally suitable ethylene polymers are stereospecifically polymerized ethylene polymers, for example, metallocene catalyst based polymers, e.g., Engage® polyethylenes which are available from Dow Chemical. Of these suitable ethylene polymers, more desirable ethylene polymers include high density polyethylene, linear low density polyethylene, medium density polyethylene, low density polyethylene and blends thereof, and the most desirable ethylene polymers include high density polyethylene and linear low density polyethylene.

Suitable propylene polymers for the present invention include homopolymers and copolymers of propylene, which include isotactic polypropylene, syndiotactic polypropylene, elastomeric homopolymer polypropylene and propylene copolymers containing minor amounts of one or more of other monomers that are known to be suitable for forming propylene copolymers, e.g., ethylene, butene, methylacrylate-co-sodium allyl sulphonate, and styrene-co-styrene sulphonamide. Also suitable are blends of these polymers, and the suitable propylene polymers may be blended with a minor amount of ethylene alkyl acrylate, e.g., ethylene ethyl acrylate; polybutylene; and ethylene-vinyl acetate. Additionally suitable propylene polymers are stereospecifically polymerized propylene polymers, for example, metallocene catalyst based polymers, e.g., Exxpol® polypropylenes which are available from Exxon Chemical. Of these suitable propylene polymers, more desirable are isotactic polypropylene and propylene copolymers containing up to about 15 wt % of ethylene.

As indicated above, the conjugate spunbond microfilaments of the invention may contain other polymers than the propylene and ethylene polymers. Fiber-forming polymers suitable for the additional or alternative polymer components of the present conjugate fibers include polyolefins, polyesters, polyamides, acetals, acrylic polymers, polyvinyl chloride, vinyl acetate-based polymer and the like, as well as blends thereof. Useful polyolefins include polyethylenes, e.g., high density polyethylene, medium density polyethylene, low density polyethylene and linear low density polyethylene; polypropylenes, e.g., isotactic polypropylene and syndiotactic polypropylene; polybutylenes, e.g., poly(1-butene) and poly(2-butene); polypentenes, e.g., poly (2-pentene), and poly(4-methyl-1-pentene); and blends thereof. Useful vinyl acetate-based polymers include polyvinyl acetate; ethylene-vinyl acetate; saponified polyvinyl acetate, i.e., polyvinyl alcohol; ethylene-vinyl alcohol and blends thereof. Useful polyamides include nylon 6, nylon 6/6, nylon 10, nylon 4/6, nylon 10/10, nylon 12, hydrophilic polyamide copolymers such as caprolactam and alkylene oxide diamine, e.g., ethylene oxide diamine, copolymers and hexamethylene adipamide and alkylene oxide copolymers, and blends thereof. Useful polyesters include polyethylene terephthalate, polybutylene terephthalate, and blends thereof. Acrylic polymers suitable for the present invention include ethylene acrylic acid, ethylene methacrylic acid, ethylene methyl methacrylate and the like as well as blends thereof. In addition, the polymer compositions of the conjugate fibers may further contain minor amounts of compatibilizing agents, colorants, pigments, thermal stabilizers, optical brighteners, ultraviolet light stabilizers, antistatic agents, lubricants, abrasion resistance enhancing agents, crimp inducing agents, nucleating agents, fillers and other processing aids.

Suitable conjugate filaments for the present invention may have a side-by-side or sheath-core configuration. When a sheath-core configuration is utilized, an eccentric sheath-core configuration, i.e., non-concentrically aligned sheath and core, is desirable since concentric sheath-core filaments have a symmetrical geometry that tends to hinder non-mechanical activation of crimps in the filaments. Of these suitable conjugate fiber configurations, more desirable are eccentric sheath-core configurations.

In accordance with the present invention, although the conjugate filaments can be crimped before or after the filaments are deposited to form a nonwoven web, it is desirable to fully crimp the filaments before they are deposited to form a nonwoven web. Since activation of crimps necessarily accompanies dimensional changes and movements of the filaments, nonwoven webs having a uniform fiber coverage tend to lose their uniformity during the crimp activation process. In contrast, nonwoven webs produced from crimped filaments have a uniform fiber coverage and do not undergo further dimensional changes. A particularly suitable process for producing a conjugate filaments spunbond web for the present invention is disclosed in U.S. Pat. No. 5,382,400 to Pike et al., which patent in its entirety is herein incorporated by reference.

Turning to FIG. 1, there is illustrated a particularly desirable spunbond web production process 10 for the present invention, which produces a lofty, low-density spunbond microfilament web. Although the conjugate microfilaments of the present invention may contain more than two component polymer compositions, for illustration purposes, FIG. 1 is depicted with a bicomponent microfilament web. A pair of extruders **12*a* and 12*b* separately extrude the propylene polymer and ethylene polymer compositions, which compositions are separately fed into a first hopper 14*a* and a second hopper 14*b*, to simultaneously supply molten polymeric compositions to a spinneret 18. Suitable spinnerets for extruding conjugate filaments are well known in the art. Briefly, the spinneret 18** has a housing which contains a spin pack, and the spin pack contains a plurality of plates and dies. The plates have a pattern of openings arranged to create flow paths for directing the two polymers to the dies that have one or more rows of openings, which are designed in accordance with the desired configuration of the resulting conjugate filaments. The openings of the plates can be arranged to provide varying amounts of the two component polymer compositions. Particularly suitable filaments contain from about 20 wt % to about 80 wt % of the propylene polymer and from about 80 wt % to about 20 wt % of the ethylene polymer, based on the total weight of the filament. As indicated above, the melt-processing temperature of the polymer compositions for the present conjugate microfilaments can be lower than conventional processing temperatures for conventional polyethylene and polypropylene utilized for spunbond filaments. The ability to process the polymer composition at a lower temperature is highly advantageous in that the lower processing temperature, for example, decreases the chance of thermal degradation of the component polymers and additives, and lessens the problems associated with quenching the spun filaments, e.g., roping of the spun filaments, in addition to reducing energy requirements.

The spinneret 18 provides a curtain of conjugate filaments or continuous fibers, and the filaments are quenched by a quench air blower 20 before being fed into a fiber draw unit 22. It is believed that the disparate heat shrinkage properties of the component polymers of the quenched conjugate fibers imparts latent crimpability in the fibers, and the latent crimpability can be heat activated. Suitable pneumatic fiber draw units for use in melt spinning polymers are well known in the art, and particularly suitable fiber draw units for the present invention include linear fiber aspirators of the type disclosed in U.S. Pat. No. 3,802,817 to Matsuki et al., which in its entirety is incorporated by reference. Briefly, the fiber draw unit 22 includes an elongate vertical passage through which the filaments are drawn by drawing air entering from the side of the passage. The drawing air, which is supplied from a compressed air source 24, draws the filaments, imparting molecular orientation in the filaments. In addition to drawing the filaments, the drawing air can be used to impart crimps in, more specifically to activate the latent crimp of, the filaments.

In accordance with the present invention, the temperature of the drawing air supplied from the air source 24 is elevated by a heater such that the heated air heats the filaments to a temperature that is sufficiently high enough to activate the latent crimp. The temperature of the drawing air can be varied to achieve different levels of crimps. In general, a higher air temperature produces a higher level of crimps, provided that the air temperature is not so high as to melt the polymer components of the filaments in the fiber draw unit. Consequently, by changing the temperature of the drawing air, filaments having different levels of crimps can be conveniently produced.

The process line 10 further includes an endless foraminous forming surface 26 which is placed below the draw unit 22 and is driven by driver rollers 28 and positioned below the fiber draw unit 22. The drawn filaments exiting the fiber draw unit are randomly deposited onto the forming surface 26 to form a nonwoven web of uniform bulk and fiber coverage. The filament depositing process can be better facilitated by placing a vacuum apparatus 30 directly below the forming surface 26 where the filaments are being deposited. The abovedescribed simultaneous drawing and crimping process is highly useful for producing lofty spunbond webs that have uniform fiber coverage and uniform web caliper. The simultaneous process forms a nonwoven web by evenly depositing fully crimped filaments, and thus, the process produces a dimensionally stabilized nonwoven web. The simultaneous process in conjunction with the high melt flow rate ethylene and propylene polymers is highly suitable for producing highly crimped conjugate microfilaments of the present invention.

The deposited nonwoven web is then bonded with any known bonding process suitable for spunbond webs. Desirably, the deposited nonwoven web is bonded with a through air bonding process since a through air bonding process effects evenly distributed interfiber bonds throughout the web without measurably compacting the web. Returning to FIG. 1, there is illustrated an exemplary through air bonder. Generally described, a through air bonder 36 includes a perforated roller 38, which receives the web, and a hood 40 surrounding the perforated roller. Heated air, which is sufficiently hot enough to partically melt the lower melting component polymer of the conjugate fiber, is supplied to the web through the perforated roller 38 and withdrawn by the hood 40. The heated air partially melts the lower melting polymer, i.e., the ethylene polymer, and the melted polymer forms interfiber bonds throughout the web, especially at the cross-over contact points of the filaments. Alternatively, the unbonded nonwoven web can be bonded with a calender bonder. A calender bonder is typically an assembly of two or more of abuttingly placed heated rolls that forms a nip to apply a combination of heat and pressure to melt fuse the fibers or filaments of a thermoplastic nonwoven web, thereby effecting a pattern of bonded regions or points in the web.

As discussed above, the pneumatically drawn filaments containing the high melt flow rate polymers provide high levels of crimps even at very fine deniers and thus can be fabricated into lofty, low-density nonwoven webs of microfilaments. For example, the conjugate fibers can be processed to provide a fiber web having a bulk of at least about 18 mils per ounce per square yard (0.013 mm/g/m$^2$), as measured under a 0.05 psi (0.34 kPa) load, even when the size of the fibers is reduced to a weight-per-unit length equal to or less than about 1.5 dtex, desirably a weight-per-unit-length between about 1.0 dtex and about 0.10 dtex, more desirably a weight-per-unit-length between about 0.6 dtex and about 0.15 dtex. In addition, particularly desirable conjugate spunbond fiber webs for the invention have a density between about 0.01 g/cm$^3$ and about 0.075 g/cm$^3$, more desirably between about 0.03 g/cm3 and about 0.065 g/cm3, and most desirably between about 0.015 g/cm3 and about 0.06 g/cm3, when measured under a 0.05 psi (0.34 kPa) load.

The present microfilament web or fabric, especially through air bonded web, provides desirable loft, compression resistance and interfiber void structure, making the web highly suitable for fluid handling applications. In addition, the present fine filament web provides high permeability and high surface area, making the web highly suitable for various filter applications. The present lofty microfilament web also provides improved softness and hand. The textural properties make the web highly useful as an outer cover material for various disposable articles, e.g., diapers, training pants, incontinence-care articles, sanitary napkins and disposable garments; as a fluid handling material; and as a filter material. The lofty spunbond web is also highly suitable as an outer layer of a barrier composite which provides a cloth-like texture in combination with other functional properties, e.g., fluid or microbial barrier properties. For example, the lofty spunbond web can be thermally or adhesively laminated onto a film or another microfiber fabric in a conventional manner to form such barrier composites. U.S. Pat. No. 4,041,203 to Brock et al., for example, discloses a fabric-like composite containing a layer of a spunbond fiber web and a layer of a meltblown fiber web, which patent in its entirety is herein incorporated by reference. Disposable garments that can be produced from the present nonwoven web include surgical gowns, laboratory gowns and the like. Such disposable garments are disclosed, for example, in U.S. Pat. Nos. 3,824,625 to Green and 3,911,499 to Benevento et al., which patents are herein incorporated by reference.

The following examples are provided for illustration purposes and the invention is not limited thereto.

EXAMPLES

Testing procedures used:

Polymer melt flow rate—the melt flow rate was tested in accordance with ASTM D 1238-90b. Polyethylene was tested using the 190/2.16 testing condition, and polypropylene was tested using the 230/2.16 testing condition.

Bulk—the bulk of the web was measured with a Starret bulk tester under 0.05 psi (0.034 kPa) load.

Density—the density of the web was calculated based on the bulk measurement and the basis weight of the web.

Example 1 (Ex1)

A through air bonded spunbond fiber web of round eccentric sheath-core conjugate fibers containing 50 wt % linear low density polyethylene and 50 wt % polypropylene were produced using the process illustrated in FIG. 1.

The bicomponent spinning pack had 0.4 mm diameter spinholes, a 6:1 L/D ratio and a 88 holes/inch spinhole density. A high melt flow rate linear low density polyethylene (LLDPE), Aspun 6831, which has a melt flow rate of 150 g/10 min. at 190° C. under a 2.16 kg load and is available from Dow Chemical, was blended with 2 wt % of a $TiO_2$ concentrate containing 50 wt % of $TiO_2$ and 50 wt % of polypropylene, and the mixture was fed into a first single screw extruder. The LLDPE composition was extruded to have a melt temperature of about 390° F. (199° C.) as the extrudate exits the extruder. A high melt flow rate polypropylene, NRD51258, which has a melt flow rate (MFR) of about 100 g/10 min. at 230° C. under a 2.16 kg load and is available from Shell Chemical, was blended with 2 wt % of the above-described Ticoncentrate, and the mixture was fed to a second single screw extruder. The melt temperature of the polypropylene composition was processed at 410° F. (210° C.). The LLDPE and polypropylene extrudates were fed into the spinning pack which was kept at about 400° F. (204° C.), and the spinhole throughput rate was kept at 0.4 gram/hole/minute. The bicomponent fibers exiting the spinning pack were quenched by a flow of air having a flow rate of 45 SCFM/inch (0.5 m3/min/cm) spinneret width and a temperature of 65° F. (18° C.). The quenching air was applied about 5 inches (13 cm) below the spinneret. The quenched fibers were drawn and crimped in the fiber draw unit using a flow of air heated to about 250° F. (121° C.) and supplied a pressure of 12 psi (83 kPa). Then, the drawn, crimped fibers were deposited onto a foraminous forming surface with the assist of a vacuum flow to form an unbonded fiber web. The unbonded web on the forming surface was passed under a flow of heated air that was applied by a slot nozzle that is placed about 1.75 inches above the forming surface to further consolidated the web. The heated air was applied at a pressure of 1.5 inch water and a temperature of 400° F. (204° C.). Then the web was convey to a through air bonder. The bonder exposed the nonwoven web to a flow of heated air having a temperature of about 260° F. (127° C.) and a flow rate of about 200 feet/min (61 m/min). The average basis weight of the web was 2.5 ounce per square yard (85 g/m2). The fiber size and bulk of the bonded web were measured, and the results are shown in Table 1.

Comparative Examples 1 (C1)

Comparative Example 1 was conducted to demonstrate the importance of using high melt flow rate polymers in producing a lofty fine filament web. The procedure outlined for Example 1 was basically repeated with the following modifications. LLDPE 6811A and polypropylene 3445 were used in place of the high melt flow rate polymers. The LLDPE has a melt flow rate of about 40 g/10 min. and is a conventional spunbond fiber grade LLDPE which is available from Dow. The polypropylene has a melt flow rate of about 35 g/10 min., and is a conventional spunbond fiber grade polypropylene which is available from Exxon. Additional changes were that the spin pack used had 0.6 mm diameter spinholes and had a hole density of 88 holes/inch, the throughput rate was reduced to 0.3 gram/hole/minute in an attempt to reduce the filament size, and the melt temperatures of the two polymers were processed at 450° F. (232° C.) and the spin pack temperature was increased to 450° F. (232° C.) in order to improve the flowability of the melt-processed polymers. The produced web was relatively flat. The results are shown in Table 1.

Comparative Example 2 (C2)

Comparative Example 2 was conducted to demonstrate the importance of using high melt flow rate polymers for both polymer components of the conjugate filaments. Generally, the procedure outlined for Example 1 was repeated, except a side-by-side pack was used and LLDPE 6811A was used in place of the high melt flow LLDPE. The spin pack had 0.35 mm spin holes and a 160 holes per inch (63 holes/cm) hole density. The spin pack was kept at 422° F. (217° C.), and the throughput rate was 0.3 gram/hole/minute.

Again, the resulting web was relatively flat, and the results are shown in Table 1.

TABLE 1

| | Melt Flow Rate | | Fiber | | Web | | | | |
|---|---|---|---|---|---|---|---|---|---|
| | LLDPE | PP | Size | | Weight | | Bulk | | Density |
| Example | (g/10 min) | | (den) | (dtex) | (osy) | (g/m2) | (inch/osy) | (mm/g/m2) | (g/cm3) |
| Ex 1 | 140 | 100 | 0.59 | 0.66 | 2.5 | 85 | 0.022 | 0.016 | 0.061 |
| C1 | 40 | 35 | 1.4 | 1.6 | 1.5 | 51 | 0.016 | 0.012 | 0.082 |
| C2 | 40 | 100 | 0.8 | 0.9 | 3.0 | 102 | 0.016 | 0.012 | 0.084 |

The filaments of Example 1 were highly crimped microfilaments, whereas the filaments of Comparative Examples 1–2 had low levels of crimps. Consequently, the web of Example 1 was bulky or lofty and had a low density, whereas the webs of Comparative Examples 1–2 were relatively flat.

Although the polymer throughput rate of Comparative Examples 1 and 2 was lower and, in addition, the spin hole size of Comparative Example 2 was smaller than those of Example 1, the filaments of Example 1 were finer and had more crimps, clearly demonstrating the efficacy of using high melt flow rate component polymers in efforts to produce bulky nonwoven webs containing microfilaments. The above results clearly demonstrate that the use of high melt flow rate component polymers for conjugate filaments not only facilitates the production of finer filaments but also enables the production of low density webs that contain highly crimped microfilaments.

Example 2

Example 2 was conducted to demonstrate that microfilaments even finer than the filaments of Example 1 can be produced in accordance with the present invention. The procedure outlined in Example 1 was generally repeated to produce bicomponent microfilaments, except that the spin pack was kept at 410° F. (217° C.), the drawing air pressure was 10 psi (69 kPa), the drawing air temperature was ambient temperature, and the throughput rate was 0.35 gram/hole/minute.

The microfilaments produced had a weight-per-unit-length of 0.5 dtex. The production of the microfilaments clearly demonstrates that a wide range of microdenier spunbond filaments and nonwoven webs produced therefrom can be produced in accordance with the present invention.

What is claimed is:

1. A lofty nonwoven web comprising spunbond microfilaments, wherein said lofty web has a density from about 0.01 g/cc to about 0.075 g/cc and said microfilaments have a weight-per-unit length between about 0.66 dtex and about 1.0 dtex.

2. The lofty nonwoven web of claim 1 wherein said microfilaments are multicomponent conjugate filaments.

3. The lofty nonwoven web of claim 2 wherein said web is a through air bonded web.

4. The lofty nonwoven web of claim 2 wherein said microfilaments are bicomponent spunbond conjugate filaments.

5. The lofty nonwoven web of claim 2 wherein said lofty web has a density between about 0.015 g/cm$^3$ and about 0.06 g/cm3.

6. A nonwoven web comprising multicomponent spunbond conjugate microfilaments comprising an ethylene polymer having a melt flow rate between about 60 g/10 min. and about 250 g/10 min. and a propylene polymer having a melt flow rate between about 50 g/10 min. and about 250 g/10 min. wherein said lofty web has a density from about 0.01 g/cc to about 0.075 g/cc and said microfilaments have a weight-per-unit length between about 0.1 dtex and about 1.0 dtex.

7. The lofty nonwoven web of claim 6 wherein said ethylene polymer is selected from homopolymers and copolymers of ethylene and said propylene polymer is selected from homopolymers and copolymers of propylene.

8. The lofty nonwoven web of claim 7 wherein said web has a density between about 0.03 g/cm$^3$ and about 0.065 g/cm$^3$.

9. The lofty nonwoven web of claim 7 wherein said ethylene polymer is linear low density polyethylene and propylene polymer is isotactic polypropylene.

10. A disposable article comprising the lofty nonwoven web of claim 7.

11. A laminate comprising the lofty nonwoven web of claim 7.

12. A lofty nonwoven web comprising spunbond microfilaments, wherein said web is made by a process which comprises:

melt spinning continuous multicomponent conjugate filaments comprising a high melt flow rate ethylene polymer and a high melt flow rate propylene polymer, said ethylene polymer and propylene polymer being arranged to occupy distinct zones across the cross-section along the length of said conjugate filaments, said ethylene polymer occupying at least a portion of the peripheral surface along the length of said conjugate filaments, wherein said ethylene polymer is a homopolymer or copolymer of ethylene and has a melt flow rate between about 60 g/10 min. and about 400 g/10 min., as measured in accordance with ASTM D1238-90b, Test Condition 190/2.16, and said propylene polymer is a homopolymer or copolymer of propylene and has a melt flow rate between about 50 g/10 min. and about 800 g/10 min., as measured in accordance with ASTM D1238-90b, Test Condition 230/2.16;

quenching the spun conjugate filaments so that the conjugate filaments have latent crimpability;

drawing the spun conjugate filaments to form microfilaments;

activating said latent crimpability so that the conjugate filaments attain crimps; and depositing the crimped filaments to form a nonwoven web, wherein said lofty web has a density from about 0.01 g/cc to about 0.075 g/cc and said microfilaments have a weight-per-unit-length between about 0.1 dtex and about 1.5 dtex.

13. The spunbond web of claim 12 wherein said ethylene polymer has a melt flow rate between about 100 g/10 min. and about 200 g/10 min., and said propylene polymer has a melt flow rate between about 60 g/10 min. and about 200 g/10 min.

* * * * *

UNITED STATES PATENT AND TRADEMARK OFFICE

CERTIFICATION OF CORRECTION

PATENT NO. : 5,672,415

DATED : September 30, 1997

INVENTOR(S): Sawyer et al.

It is certified that errors appear in the above-identified patent and that said Letters Patent is hereby corrected as shown below:

Column 6, line 46, "abovedescribed" should read --above-described--;
Column 6, line 66, "partically" should read --partially--;
Column 8, line 12, "were" should read --was--;
Column 8, line 28, "Ticoncentrate" should read --$TiO_2$ concentrate --
Column 8, line 47, "inch" should read --inches--;
Column 8, line 53, "ounce" should read --ounces--;
Column 8, line 65, "has" should read --had--;
Column 8, line 65, "is" should read --was--;
Column 9, line 6, "and the melt temperatures of the two polymers" should read --and the two polymers--;
Column 9, line 7, "at 450°" should read --at a melt temperature of 450°--;
Column 10, line 51, claim 9, "and propylene" should read --and said propylene--.

Signed and Sealed this

Twenty-third Day of February, 1999

*Attest:*

Q. TODD DICKINSON

*Attesting Officer*

*Acting Commissioner of Patents and Trademarks*